US009535374B1

(12) United States Patent
Embry et al.

(10) Patent No.: US 9,535,374 B1
(45) Date of Patent: Jan. 3, 2017

(54) POSITIONING MECHANISM FOR A ROLLER OF AN INTERMEDIATE TRANSFER MEMBER MODULE

(71) Applicant: Lexmark International, Inc., Lexington, KY (US)

(72) Inventors: Kerry Leland Embry, Midway, KY (US); Bartley Charles Gould, II, Lexington, KY (US); James Philip Harden, Lexington, KY (US); Gina Marie Johns, Georgetown, KY (US); William Claiborne Ryle, Williamstown, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/918,165

(22) Filed: Oct. 20, 2015

(51) Int. Cl.
*G03G 15/16* (2006.01)
*G03G 21/16* (2006.01)

(52) U.S. Cl.
CPC ..... *G03G 15/161* (2013.01); *G03G 15/1605* (2013.01); *G03G 21/16* (2013.01); *G03G 2215/0119* (2013.01); *G03G 2221/1642* (2013.01)

(58) Field of Classification Search
CPC ..... G03G 21/16
USPC ..... 399/121
See application file for complete search history.

(56) References Cited

U.S. PATENT DOCUMENTS 5,343,279 A * 8/1994 Nagata ..... G03G 15/2064 198/806
6,088,558 A * 7/2000 Yamada ..... G03G 15/0131 198/806
6,457,709 B1 * 10/2002 Madsen ..... B65H 5/021 271/198
7,627,268 B2 * 12/2009 Katoh ..... G03G 15/0136 399/121
8,406,665 B2 * 3/2013 Hirose ..... G03G 15/0131 198/835
9,031,461 B2 * 5/2015 Embry ..... G03G 21/1633 399/121
2005/0185988 A1 * 8/2005 Mochimaru ..... G03G 15/755 399/165
2010/0215387 A1 * 8/2010 Ishikawa ..... G03G 15/161 399/45
2012/0148300 A1 * 6/2012 Katoh ..... G03G 15/1615 399/121
2014/0294411 A1 * 10/2014 Yoshioka ..... G03G 15/1695 399/45

* cited by examiner

*Primary Examiner* — David Gray
*Assistant Examiner* — Kevin Butler

(57) ABSTRACT

An ITM module for an imaging device, including a frame; a tension roll disposed in the frame; an ITM belt rotatably coupled to the frame and formed as an endless loop around rolls of the ITM module, including the tension roll; and an adjustment mechanism coupled to an end portion of the frame and to the tension roll, the adjustment mechanism setting an amount of skew of the tension roll relative to the frame. The amount of skew is in a direction that is substantially orthogonal to a process direction of the ITM belt. The adjustment mechanism includes a cam member rotatably coupled to the frame and having a cam surface coupled a first end portion of the tension roll such that rotating the first cam member sets an amount of elevation of the first end portion of the tension roll relative to the frame.

20 Claims, 9 Drawing Sheets

POSITIONING MECHANISM FOR A ROLLER OF AN INTERMEDIATE TRANSFER MEMBER MODULE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to an imaging device and is particularly directed to an intermediate transfer member (ITM) module of the type which limits the lateral movement of the ITM belt. The present disclosure is specifically directed to an ITM module that provides adjustment of ITM belt tracking.

2. Description of the Related Art

When an ITM belt is driven around a system of rollers in an electrophotographic (EP) printer, such as a laser printer, lateral motion of the ITM belt can occur in addition to the motion in the driven direction (i.e., in the process direction). Several component dimensions directly affect ITM belt tracking, such as roll cylindricity, roll alignment, and tension variations. Historically, these dimensions are held to tolerances at the extreme of manufacturability in order to prevent an accumulation of additive effects that result in high ITM belt stress. Ultimately, it is the cyclic fatigue of the ITM belt material that continues to be a primary failure mode for the ITM module. The use of a rib to constrain ITM belt tracking improved overall robustness, but at the cost of additional components and sensitivity to rib application tolerances. Reinforcement tape also reduced fatigue failure rate, but at the cost of overall ITM width and cleaner seal difficulties. Each improvement to fatigue life has attempted to make the ITM belt more resistant to stresses induced by constraining the ITM belt in the ITM module, but with limited success.

SUMMARY

Example embodiments are directed to a mechanism for effectively and inexpensively adjusting ITM belt tracking for reducing or minimizing the overall tracking rate of the ITM belt of an ITM module located in an electrophotographic imaging device. An example embodiment is directed to an ITM module including a frame; a backup roll disposed along a first end portion of the frame, the backup roll being rotatable within the frame; a tension roll disposed along a second end portion of the frame, the tension roll being rotatable within the frame, the tension roll including a first end portion and a second end portion; and an ITM belt rotatably coupled to the frame, the ITM belt formed as an endless loop around the backup roll and the tension roll such that rotation of at least one of the backup roll and the tension roll causes the ITM belt to rotate. The ITM module further includes a first plate disposed along the second end portion of the frame on a first side thereof and coupled between the first end portion of the tension roll and the second end portion of the frame; and an adjustment mechanism coupled to the second end portion of the frame and the first plate, the adjustment mechanism setting an elevation of the first plate and the first end portion of the tension roll relative to the second end portion of the frame, wherein a direction of the elevation is in a direction that is substantially orthogonal to a process direction of the ITM belt. By adjusting the elevation of the first end portion of the tension roll, the overall ITM belt tracking rate can be substantially reduced, thereby substantially reducing ITM belt stresses and increasing ITM belt life.

The adjustment mechanism includes a first cam member pivotally coupled to one of the second end portion of the frame and the first plate, and having a cam surface which engages with the other of the second end portion of the frame and the first plate such that rotating the first cam member sets the elevation of the first plate and the first end portion of the tension roll relative to the second end portion of the frame. The adjustment mechanism further includes a second cam member rotatably coupled to the one of the second end portion of the frame and the first plate, and having a cam surface which engages with the other of the second end portion of the frame and the first plate such that rotating the second cam member at least partly sets the elevation of the first plate and the first end portion of the tension roll relative to the second end portion of the frame.

Another example embodiment is directed to an ITM module having a frame; a backup roll disposed along a first end portion of the frame, the backup roll being rotatable within the frame; a tension roll disposed along a second end portion of the frame, the tension roll being rotatable within the frame and including a first end portion and a second end portion; an ITM belt rotatably coupled to the frame and formed as an endless loop around the backup roll and the tension roll such that rotation of the backup roll and the tension roll causes the ITM belt to rotate; and an adjustment mechanism coupled to the second end portion of the frame and the tension roll. The adjustment mechanism sets an amount of skew of the tension roll relative to the second end portion of the frame, the amount of skew being in a direction that is substantially orthogonal to a process direction of the ITM belt.

The adjustment mechanism includes a first cam member rotatably coupled to one of the second end portion of the frame and first end portion of the tension roll and having a cam surface coupled to the other of the second end portion of the frame and the first end portion of the tension roll such that rotating the first cam member adjusts the elevation of the first end portion of the tension roll relative to the second end portion of the frame. The adjustment mechanism further includes a plate member coupled between the second end portion of the frame and the first end portion of the tension roll. The first cam member is rotatably coupled to one of the second end portion of the frame and the plate member, and the cam surface of the first cam is coupled to the other of the second end portion of the frame and the plate member. Rotating the first cam member sets the elevation of the first end portion of the tension roll and the plate member relative to the second end portion of the frame.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
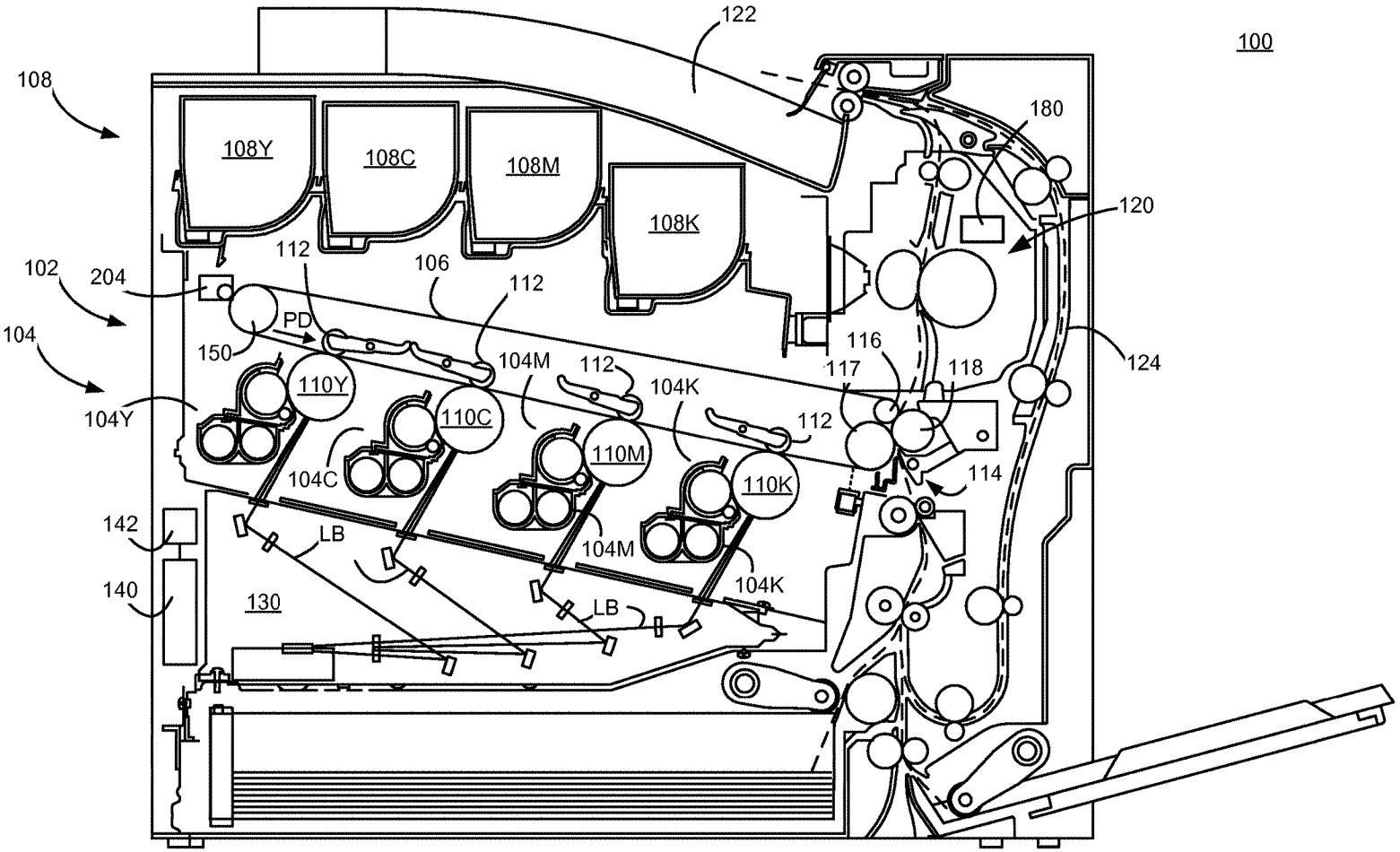
FIG. 1 is a side elevational view of an imaging device having therein an ITM module according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and an herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104Y, 104C, 104M and 104K that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to a process direction PD of the ITM belt 106 indicated by the arrow in FIG. 1, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110Y, 110C, 110M and 110K that receives toner therefrom during toner development to form a toned image thereon. Each photoconductive member 110 is paired with a transfer member 112 for use in transferring toner to ITM belt 106 at first toner transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. During image forming or imaging operations, ITM belt 106 moves past photoconductive members 110 in process direction PD as viewed in FIG. 1. One or more of photoconductive members 110 applies its toner image in its respective color to ITM belt 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between back-up roll 116, drive roll 117 and a second transfer roller 118. Tension roll 150 is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Figure 2A:
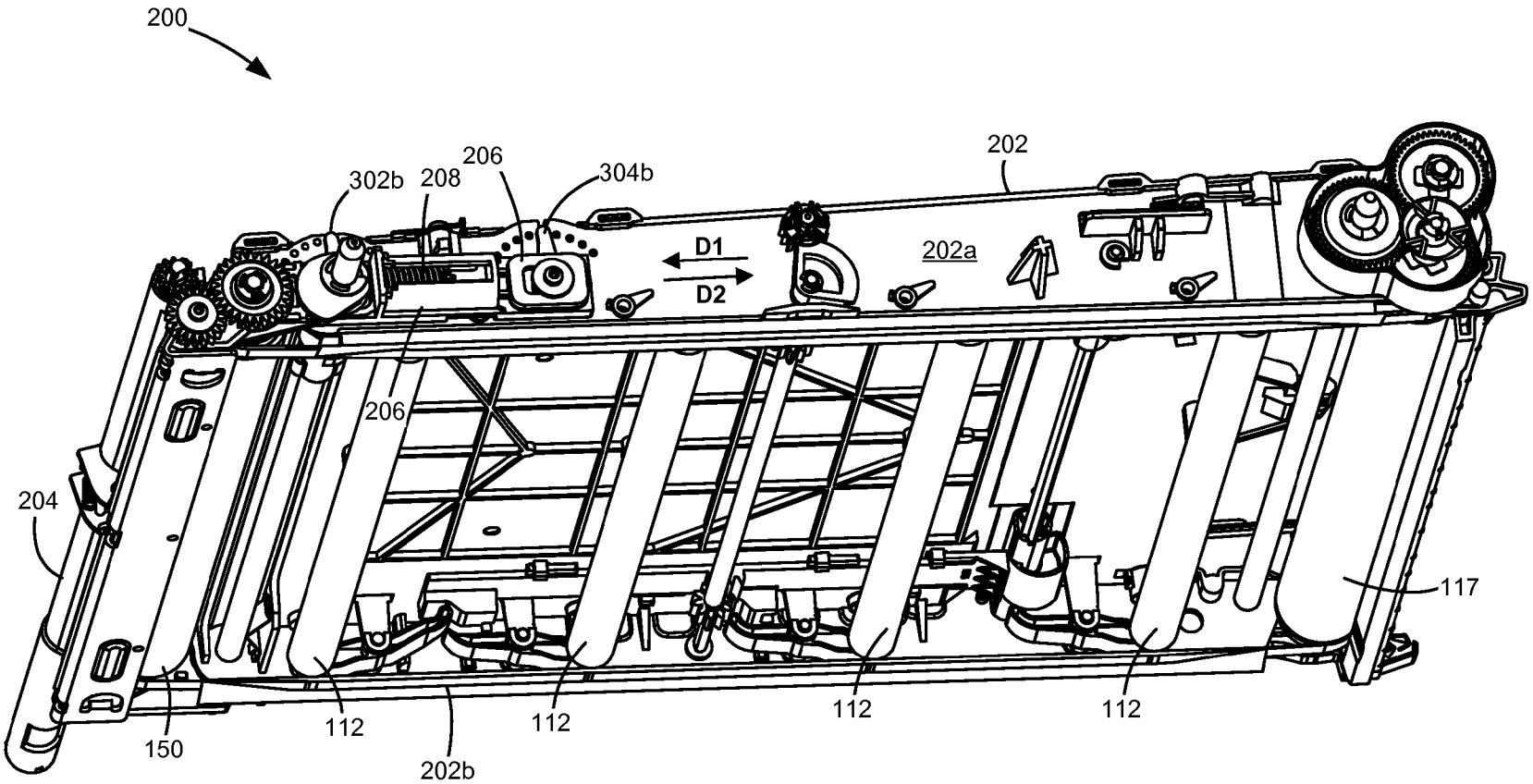
FIG. 2*a* is a perspective view of the ITM module of FIG. 1 without an ITM belt, according to an example embodiment.
Figure 2B:
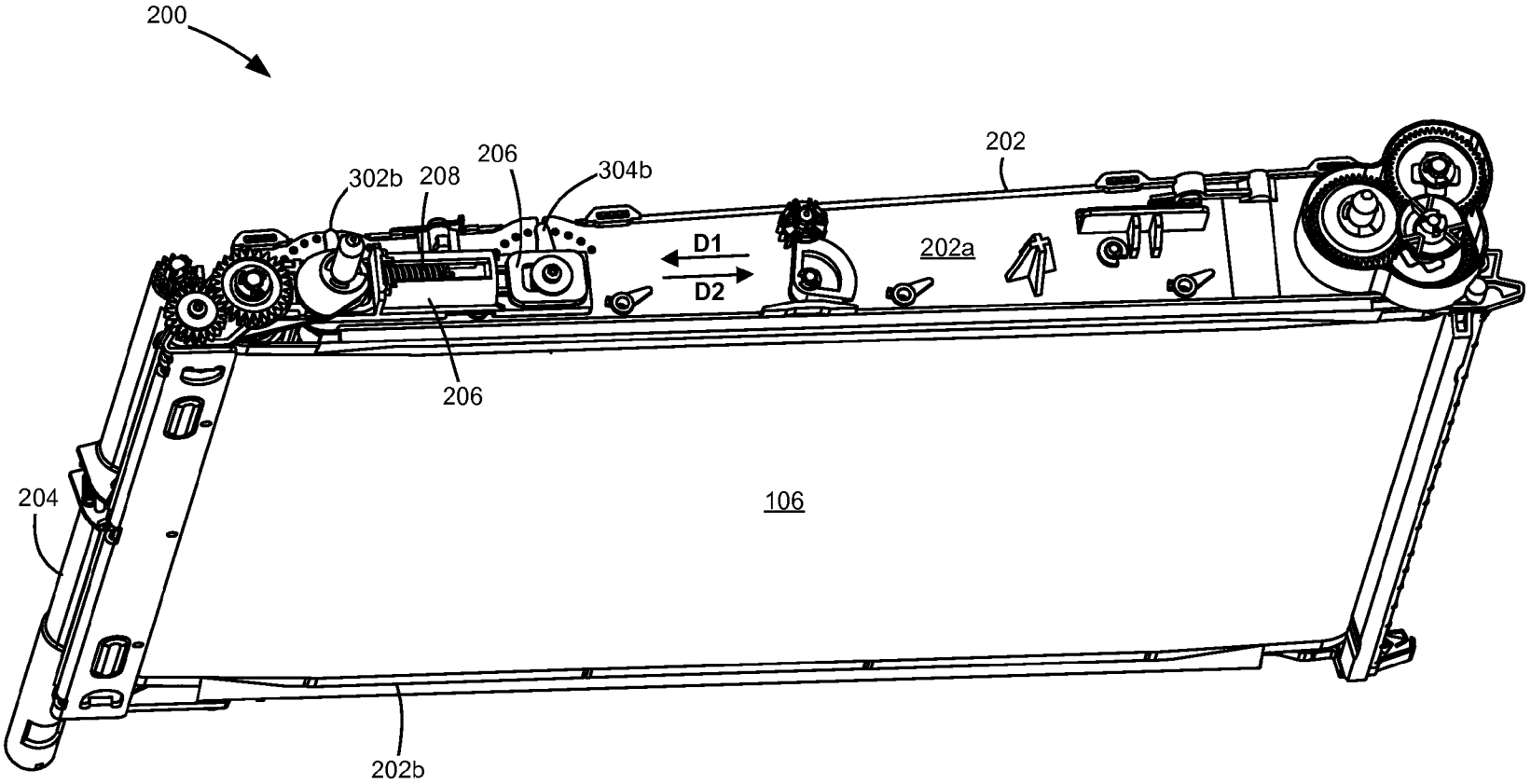
FIG. 2*b* is a perspective view of the ITM module of FIG. 1 with an ITM belt, according to an example embodiment.

ITM belt 106 may be part of an ITM module in which ITM belt 106, transfer members 112, backup roll 116, drive roll 117 and tension roll 150 are disposed. Referring to FIGS. 2*a* and 2*b*, ITM module 200 includes a frame 202. Transfer members 112 are rotatably coupled at spaced apart locations along the length of frame 202 and biased substantially downwardly so as to be positioned against a corresponding photoconductive member 110Y, 110C, 110M and 110K through ITM belt 106. Backup roll 116 and drive roll 117 are disposed at a front end of frame 202, and tension roll 150 is disposed at a back end of frame 202. ITM belt 106 is disposed around backup roll 116, drive roll 117 and tension roll 150 so as to be rotatably engaged therewith. In an example embodiment, drive roll 117 is a driven roll such that rotation of drive roll 117 causes backup roll 116, second transfer roll 118, and tension roll 150 to rotate about their respective axes and ITM belt 106 to rotate. ITM module 200 further includes a cleaning unit 204 (FIGS. 1 and 2*a*, 2*b*) which is disposed at the back end portion of frame 202. Cleaning unit 204 includes a blade (not shown) which contacts ITM belt 106 to remove residual toner therefrom. Cleaning unit 204 is disposed upstream of yellow developer unit 104Y along ITM belt 106 so that residual toner is removed therefrom prior to a subsequent imaging operation. Cleaning unit 204 may also include an interior space for collecting the residual toner that is removed by the blade of cleaning unit 204 and an auger for moving the collected residual toner to a waste toner container (not shown) in imaging device 100. The blade of cleaning unit 204 contacts ITM belt 106 at a location adjacent to the location of tension roll 150. In this way, tension roll 150 provides a surface against which the blade of cleaning unit 204 may indirectly contact to ensure effective removal of residual toner from ITM belt 106.

ITM module 200 further includes tension plates 206 and 207 which couple tension roll 150 and cleaning unit 204 to frame 202. As shown in FIGS. 2-3 and 5-7, tension plate 206 (shown in dashed lines in FIG. 3) is disposed on and coupled to a first side 202*a* of frame 202, and tension plate 207 (not shown) is disposed on and coupled to a second side 202*b* of frame 202 that is opposite first side 202*a*. Each of tension plates 206 and 207 is slidingly attached to sides 202*a* and 202*b*, respectively, of frame 202 so that tension plates 206 and 207, as well as tension roll 150, are slidable in directions D1 and D2 as shown in FIGS. 2*a* and 2*b*. Specifically, tension plate 206 includes slots 206*a* and 206*b* (best seen in FIG. 3), each of which is defined along a length of tension plate 206. Similarly, tension plate 207 includes slots 207*a* and 207*b* (not shown), each of which is defined along a length of tension plate 207. Each of slots 206*a* and 206*b* of tension plate 206 engages with a post extending from side 202*a* of frame 202, and each of slots 207*a* and 207*b* of tension plate 207 engages with a post (not shown) extending from side 202*b* of frame 202. In this way, tension plates 206 and 207 are translatable in direction D1 and D2 relative to frame 202.

ITM module 200 further includes bias members 208. A first end of a first bias member 208 is connected to the first side 202*a* of frame 202 and a second end of first bias member 208 is connected to tension plate 206. Similarly, a first end of a second bias member 208 (not shown) is connected to the second side 202*b* of frame 202 and a second end of second bias member 208 is connected to tension plate 207. Bias members 208 bias tension plates 206 and 207 to translate tension roll 150 in direction D which is substantially parallel to the process direction PD of ITM belt 106 (FIG. 1) so that ITM belt 106 has a predetermined amount of tension for proper image quality and drive capability. The use of slidable tension plates 206 and 207 and bias members 208 as described above result in tension roll 150 "floating" relative to frame 202 of ITM module 200.

According to an example embodiment, ITM module 200 includes a positioning mechanism to selectively position or reposition tension roll 150 within ITM module 200. The positioning mechanism provides the ability to adjust the elevation of one end of tension roll 150 within frame 202 relative to the plane of ITM belt 106 to which toner images are transferred. In other words, the positioning mechanism provides the ability to adjust the skew of tension roll 150 within frame 202. The positioning mechanism is located along first side 202*a* of frame 202 so that only the end of tension roll 150 that is coupled to tension plate 206 is capable of having its elevation adjusted, relative to frame 202. The other end of tension roll 150, i.e., the end which is coupled to tension plate 207, does not include a positioning mechanism for elevation adjustment. By adjusting the elevation of only one end of tension roll 150, the skew of tension roll 150 can be set to a skew amount so that tracking of ITM belt 106 is substantially reduced, thereby minimizing or substantially reducing bias related stresses on ITM belt 106 and increasing the life thereof.

Figure 3:
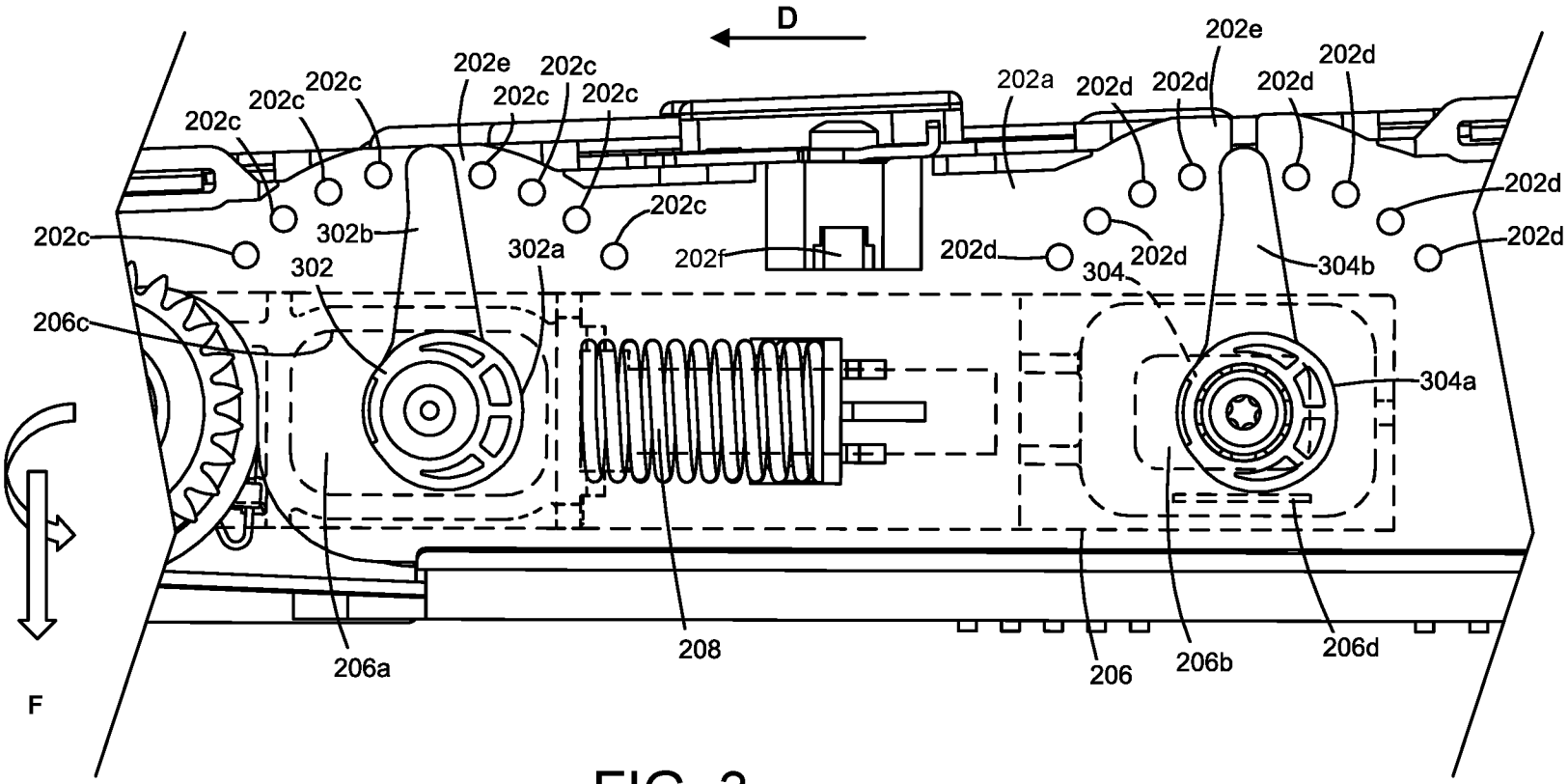
FIG. 3 is a view of an adjustment mechanism of the ITM module of FIGS. 2*a* and 2*b* according to an example embodiment.

With reference to FIGS. 2*a*, 2*b*, and 3, the positioning mechanism includes a dual cam structure, having cams 302 and 304. Cams 302 and 304 are each rotatably coupled to first side 202*a* of frame 202. In an example embodiment, each of cams 302 and 304 includes a stepped cam surface 302*a* and 304*a*, respectively, for contacting tension plate 206 such that rotation of cams 302 and 304 causes the elevation of tension plate 206 to increase or decrease, relative to frame 202.

Figure 4:
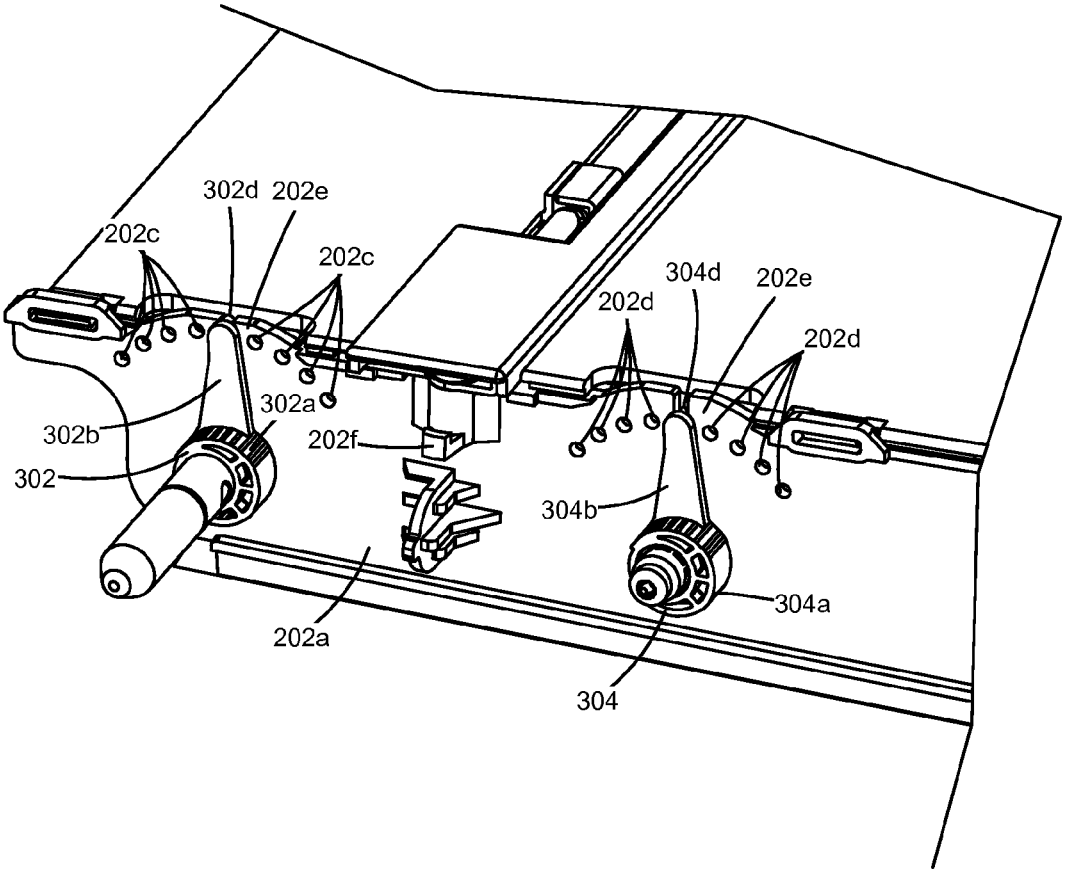
FIG. 4 is a perspective view of a portion of the adjustment mechanism of FIG. 3 according to an example embodiment.

FIG. 4 depicts cams 302 and 304 according to an example embodiment. In the example embodiment, cams 302 and 304 are identical to each other. Cam surface 302*a*, 304*a* each includes a plurality of steps, with each step corresponding to a distinct elevation adjustment location for tension plate 206. Each cam 302, 304 further includes an extension portion 302*b*, 304*b*, respectively. Extension portions 302*b*, 304*b* extend radially outwardly from a central portion of cams 302, 304, respectively. A distal end of extension portions 302*b*, 304*b* is engageable with first side 202*a* of frame 202. In an example embodiment, the distal end of extension portions 302*b*, 304*b* includes a protrusion 302*d*, 304*d*, respectively. Each protrusion 302*d*, 304*d* extends substantially orthogonally from extension portions 302*b*, 304*b*, respectively. First side 202*a* includes a plurality of apertures 202*c* and 202*d* arranged relative to cams 302, 304, respectively, as shown in FIGS. 3 and 4, so that each aperture 202*c* and 202*d* is capable of forming a temporary snap fit type of engagement with protrusions 302*d* and 304*d*, respectively. Specifically, apertures 202*c* are arranged about cam 302, and apertures 202*d* are arranged about cam 304. In the example embodiment, the number of apertures 202*c* and the number of apertures 202*d* are the same, and such number corresponds to the number of steps along cam surfaces 302*a* and 304*a*. As cam 302 is rotated, protrusion 302*d* is engageable with apertures 202*c* in a snap fit engagement therewith. Similarly, as cam 304 is rotated, protrusion 304*d* is engageable with apertures 202*d* in a snap fit engagement therewith. In this way, cams 302 and 304 may each be adjustable into any one of a number of positions relative to first side 202*a* of frame 202.

In an example embodiment, cams 302 and 304 extend at least partly in slots 206*a* and 206*b*, respectively. The cam surfaces of cams 302 and 304 contact an edge of slots 206*a* and 206*b*, respectively. Due to its weight and its indirect contact with tension roll 150 for cleaning ITM belt 106 as described above, cleaning unit 204 presents a largely downward force F (FIG. 3) relative to frame 202, creating a moment on tension plate 206 in a largely counterclockwise direction relative to the locations tension plate 206 is attached to frame 202. As a result and to counteract the moment created, the cam surface 302*a* of cam 302 contacts an upper edge or ledge 206*c* of slot 206*a* and the cam surface 304*a* of cam 304 contacts a lower edge or ledge 206*d* at or below slot 206*b*. Edge 206*d* may be disposed along an inner side of tension plate 206 which faces first side 202*a* of frame 202. With each step of cam surface 302*a* of cam 302 being at a distinct radial distance from a rotational axis of cam 302, rotation of cam 302 results in the elevation of tension plate 206 being adjusted relative to frame 202, with each step of cam surface 302*a* providing a distinct elevation of tension plate 206 when contacting upper edge 206*c* of slot 206*a*. Similarly, with each step of cam surface 304*a* of cam 304 being at a distinct radial distance from a rotational axis of cam 304, rotation of cam 304 results in the elevation of tension plate 206 being adjusted relative to frame 202, with each step of cam surface 304*a* providing a distinct elevation of tension plate 206 when contacting lower edge 206*d*. In the example embodiment, cams 302 and 304 are rotated the same when elevating tension plate 206 and the corresponding end of tension roll 150.

In an example embodiment, the number of apertures 202*c* and the number of apertures 202*d* of frame 202 is nine. According to an example embodiment, the number of steps in each of cams 302 and 304 is also nine. As a result, tension plate 206 and the end of tension roll 150 coupled thereto are thus adjustable to any of nine discrete elevation levels, relative to frame 202. For example, tension plate 206 and the corresponding end of tension roll 150 are adjustable in 0.25 mm increments between +1 mm and −1 mm out of the plane of ITM belt 106 on which toner is imaged. With this amount of adjustability, tracking bias of ITM belt 106 can be substantially reduced.

Figure 5:
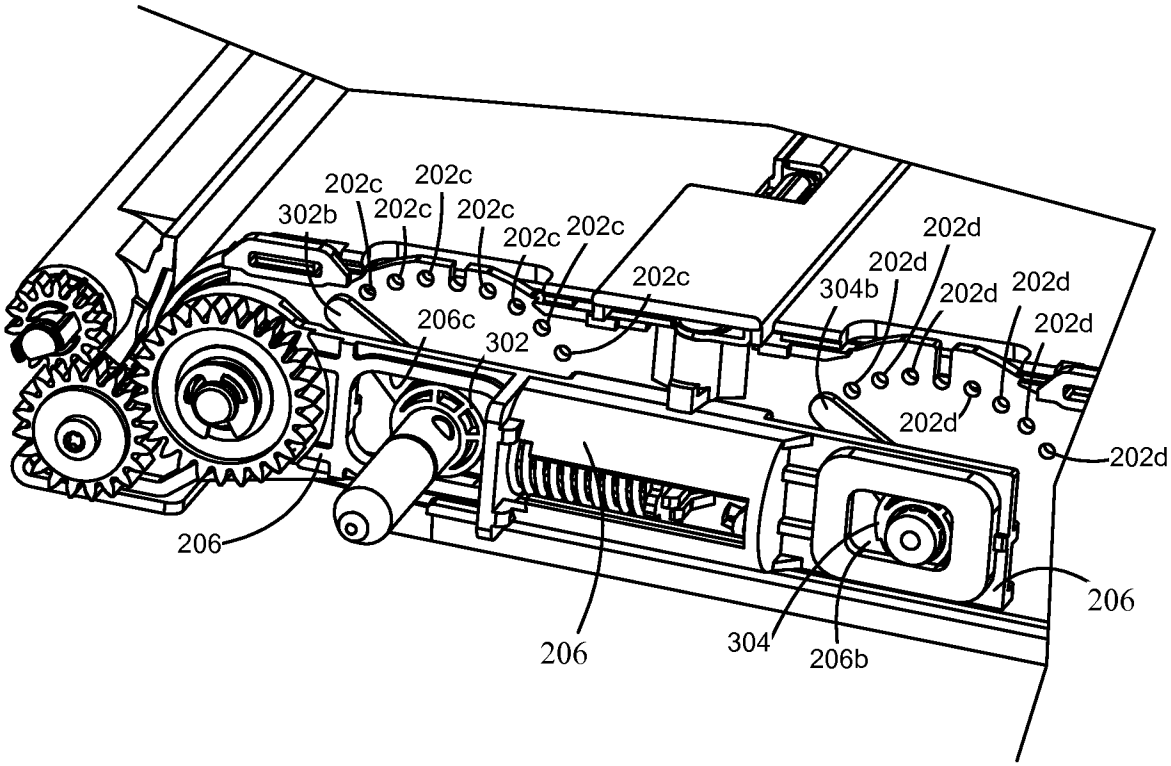
FIGS. 5-7 are views of the adjustment mechanism of FIG. 3 configured in three different settings.
Figure 6:
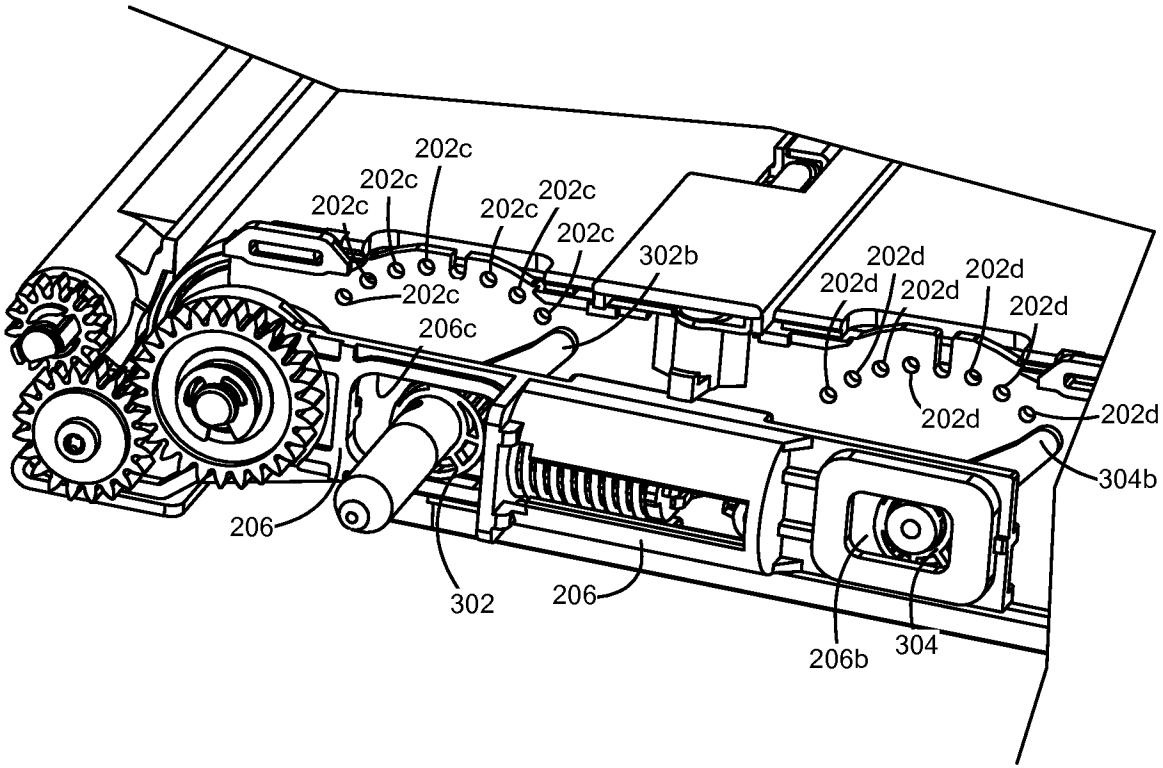
Figure 7:
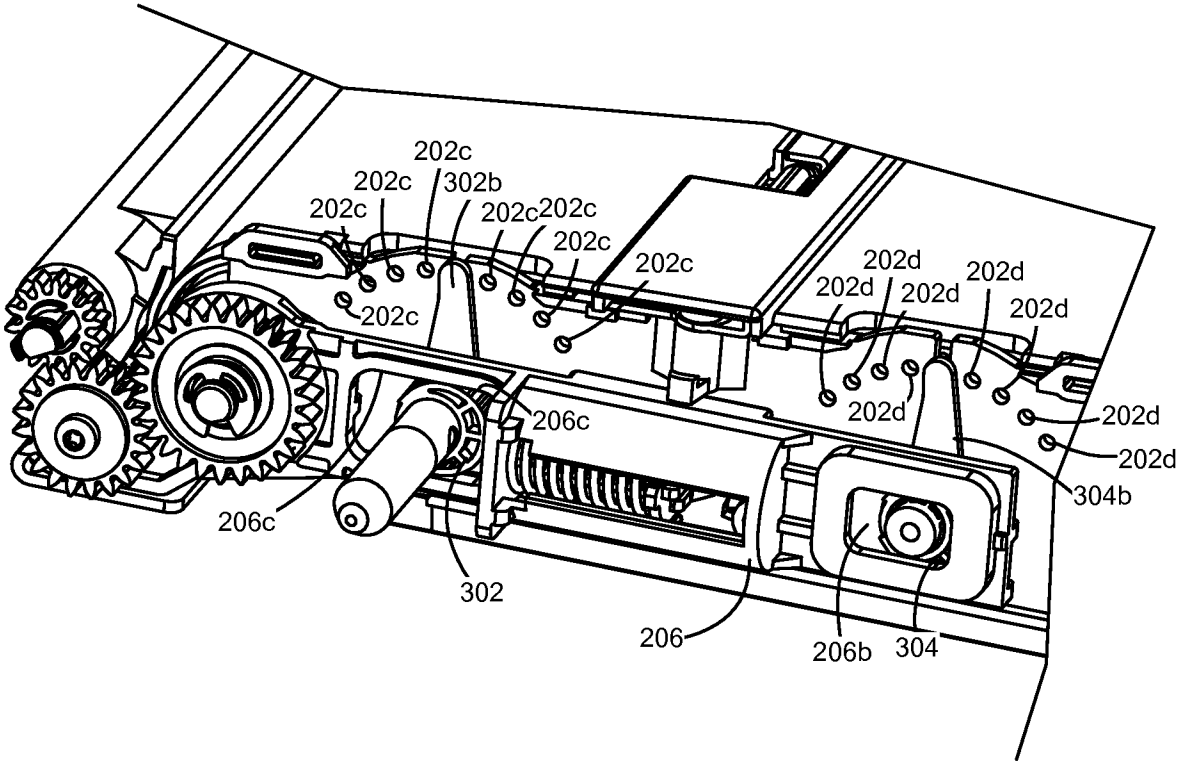

FIGS. 5-7 illustrate the elevation settings for tension roll 150 relative to frame 202. FIG. 5 illustrates tension roll 150 having its highest elevation. In this position, cam surface 302*a* of cam 302 provides the most separation between edge 206*c* and the rotational axis of cam 302; and cam surface 304*a* of cam 304 provides the least separation between edge 206*d* and the rotational axis of cam 304. FIG. 6 illustrates tension roll 150 having the lowest elevation, relative to frame 202. In this position, cam surface 302*a* of cam 302 provides the least separation between edge 206*c* and the rotational axis of cam 302; and cam surface 304*a* of cam 304 provides the most separation between edge 206*d* and the rotational axis of cam 304. FIG. 7 illustrates tension roll 150 having an elevation that is substantially half of distance between the highest elevation (FIG. 5) and the lowest elevation (FIG. 6). In this position, cam surface 302*a* of cam 302 provides about the same separation between edge 206*c* and the rotational axis of cam 302 as the separation between edge 206*d* and the rotational axis of cam 304 provided by cam surface 304*a* of cam 304.

Figure 8:
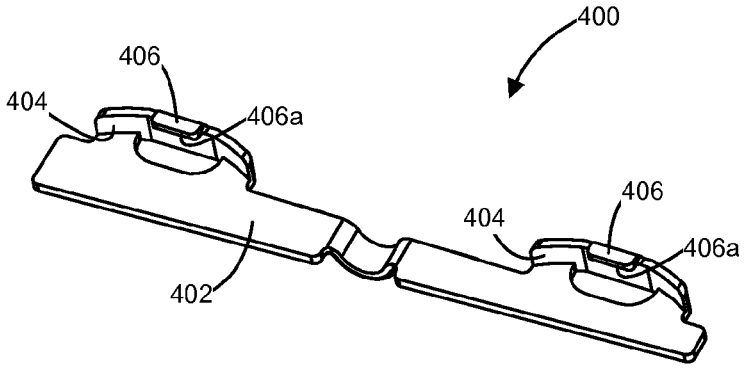
FIG. 8 is a perspective view of a cover member of the adjustment mechanism of FIG. 3 according to an example embodiment.
Figure 9:
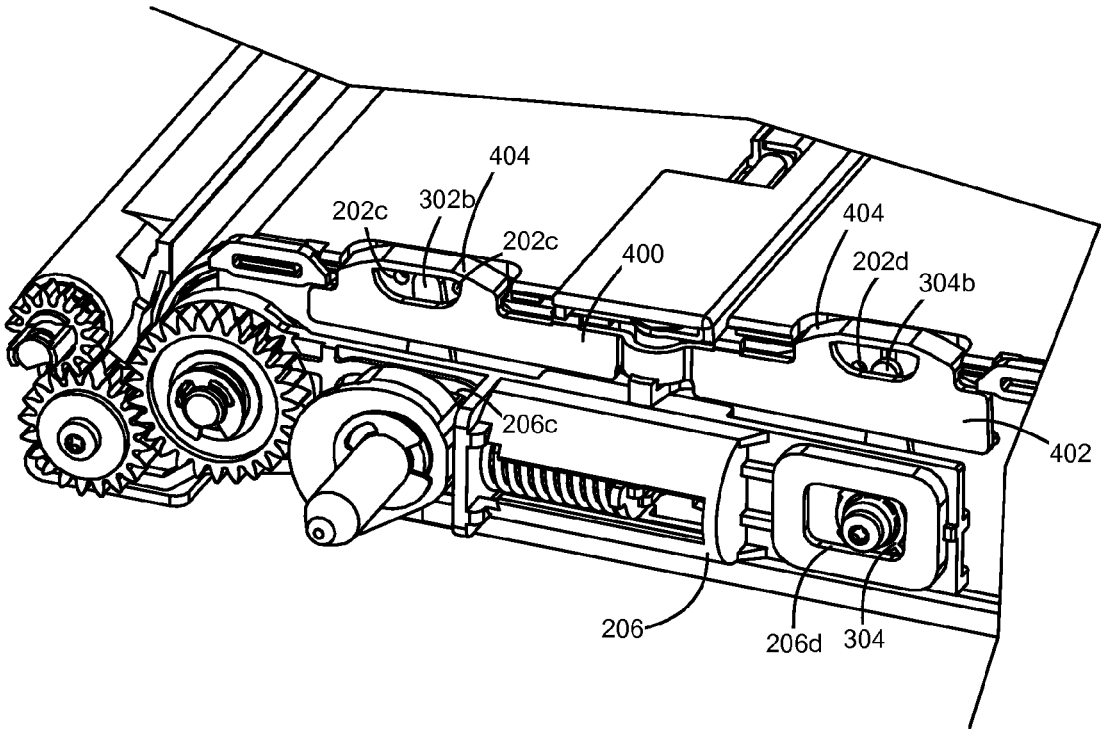
FIG. 9 is a perspective view of the cover member of FIG. 5 covering a portion of the ITM module of FIGS. 2*a* and 2*b*.

In accordance with an example embodiment, the positioning mechanism further includes a cover member 400 for covering extension portions 302*b* and 304*b* of cams 302 and 304, respectively, as well as the upper portion of first side 202*a* of frame 202. With reference to FIGS. 8 and 9, cover member 400 includes an elongated portion 402 from which a pair of sidewalls 404 extend in a largely orthogonal direction. Each sidewall 404 may be curved and otherwise dimensioned so as to at least partly fit over the rounded portions 202*e* (FIG. 3) of first side 202*a* through which apertures 202*c* and 202*d* are defined. Ledges 406 are disposed along a distal end of sidewalls 404 and extend in a direction that is substantially orthogonal to sidewalls 404. First side 202*a* of frame 202 further includes a landing 202*f* (FIGS. 3 and 4) which extends outwardly from first side 202*a* for receiving and supporting elongated portion 402 when cover member 400 covers extension portions 302*b* and 304*b* of cams 302 and 304, respectively. Cover member 400 is secured to first side 202*a* of frame 202 in a snap fit engagement, with ledges 406 disposed along a back surface of first side 202*a* and elongated portion 402 disposed along a front surface thereof. When cover member 400 is secured to first side 202*a* as described above, cover member 400 serves to prevent cams 302 and 304 from being inadvertently repositioned.

A method of adjusting the skew of tension roll 150 relative to frame 202 so as to reduce or minimize the tracking rate of ITM belt 106 will be described. It is contemplated that cams 302 and 304 are adjusted only once, at the time ITM module 200 is assembled. Once ITM module 200 has been assembled, the assembly operator positions cams 302 and 304 as determined by an automated fixture. The automated fixture alters the planarity of ITM module 200 by changing the positions of cams 302 and 304 and recording the resulting belt tracking rate of ITM belt 106 in each position. Laboratory measurements have shown these belt tracking rates can be linearly interpolated with the planarity displacement to determine the appropriate position for cams 302 and 304 yielding the smallest tracking rate of ITM belt 106. As a result, adjusting the skew of tension roll 150 and with it the planarity of ITM module 200 serves to balance the mechanical influences on lateral motion of ITM belt 106. With the mechanical influences of lateral belt motion balanced in this way, stresses on ITM belt 106 are reduced so as to improve belt life.

FIGS. 3-7 illustrate an example embodiment in which cams 302 and 304 are rotatably attached to first side 202*a* of frame 202, with the cam surface of each cam 302 and 304 contacting an edge of tension plate 206 for elevating same. It is understood that in an alternative embodiment, cams 302 and 304 are rotatably attached to tension plate 206 and include cam surfaces that contact edges formed on first side 202*a* of frame 202. Adjustment of tension plate 206 and the corresponding end of tension roll 150 may then be performed the same way as described above—rotating cams 302 and 304 cause their cam surfaces to adjust the elevation of tension plate 206 and the end of tension roll 150 coupled thereto. In yet another alternative embodiment, the positioning mechanism described above may be associated with a roll of ITM module 200 other than tension roll 150.

In an example embodiment described above, cams 302 and 304 are described as stepped cams for providing a number of discrete elevations of tension plate 206 and the end of tension roll 150 coupled thereto. In an alternative embodiment, cam surfaces 302*a* and 304*a* of cams 302 and 304, respectively, are not stepped surfaces and instead are smooth, continuous surfaces. As a result of cam surfaces 302*a* and 304*a* being smooth, continuous surfaces, tension plate 206 and the end of tension roll 150 coupled thereto may be adjustable into any one of seemingly infinite number of elevations relative to frame 202, and may be locked to the desired elevation using a screw or clamp.

The description of the details of the example embodiments have been described in the context of a color electrophotographic imaging devices. However, it will be appreciated that the teachings and concepts provided herein are applicable to multifunction products employing color electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An intermediate transfer member (ITM) module for an electrophotographic imaging device, comprising:

a frame;

a backup roll disposed along a first end portion of the frame, the backup roll being rotatable within the frame;

a tension roll disposed along a second end portion of the frame, the tension roll being rotatable within the frame, the tension roll including a first end portion and a second end portion;

an ITM belt rotatably coupled to the frame, the ITM belt formed as an endless loop around the backup roll and the tension roll such that rotation of at least one of the backup roll and the tension roll causes the ITM belt to rotate;

a first plate disposed along the second end portion of the frame on a first side thereof and coupled between the first end portion of the tension roll and the second end portion of the frame; and an adjustment mechanism coupled to the second end portion of the frame and the first plate, the adjustment mechanism setting an elevation of the first plate and the first end portion of the tension roll relative to the frame, a direction of the elevation being in a direction that is substantially orthogonal to a process direction of the ITM belt, wherein the adjustment mechanism comprises a first cam member pivotally coupled and pivots relative to one of the second end portion of the frame and the first plate, and having a cam surface which engages with the other of the second end portion of the frame and the first plate such that rotating the first cam member sets the elevation of the first plate and the first end portion of the tension roll relative to the second end portion of the frame.

2. The ITM module of claim 1, wherein the adjustment mechanism further comprises a second cam member pivotally coupled to the one of the second end portion of the frame and the first plate, and having a cam surface which engages with the other of the second end portion of the frame and the first plate such that rotating the second cam member at least partly sets the elevation of the first plate and the first end portion of the tension roll relative to the second end portion of the frame.

3. The ITM module of claim 2, wherein the first plate includes a first ledge that engages with the cam surface of the first cam member and a second ledge that engages with the cam surface of the second cam member such that rotation of the first cam member and the second cam member changes the elevation of the first plate and the one end portion of the tension roll relative to the frame.

4. The ITM module of claim 3, wherein the first plate comprises a first opening, the first ledge forming at least part of the first opening.

5. The ITM module of claim 3, wherein the first ledge is along an upper portion of the first opening and the second ledge is along a lower portion of the first plate.

6. The ITM module of claim 2, wherein each of the first cam member and the second cam member includes a cam extension portion, a distal end portion of each cam extension portion is selectively engaged with the one of the second end portion of the frame and the first plate so as to secure the first cam member into any one of a plurality of fixed positions relative to the frame.

7. The ITM module of claim 6, wherein for each of the first cam member and the second cam member, the one of the second end portion of the frame and the first plate includes a plurality of position landing locations, each position landing location being engageable with the distal end portion of the cam extension portion of a corresponding cam member.

8. The ITM of claim 6, wherein the adjustment mechanism further comprises a cover member which removably attaches to the one of the second end portion of the frame and the first plate and covers the cam extension portions so as to prevent inadvertent rotation of the first and second cam members.

9. The ITM module of claim 2, wherein each of the first cam member and the second cam member is selectively engaged with the one of the second end portion of the frame and the first plate so as to be capable of securing the cam member into any of a plurality of positions relative to the frame.

10. The ITM module of claim 1, further comprising:

a first bias member having a first end coupled to the second end portion of the frame and a second end coupled to the first plate, the first bias member urging the first plate in a direction that is substantially orthogonal to a direction of elevation of the first plate and the first end portion of the tension roll;

a second plate disposed along the second end portion of the frame on a second side thereof opposite the first side and coupled between the second end portion of the tension roll and the second end portion of the frame; and a second bias member having a first end coupled to the second end portion of the frame and a second end coupled to the second plate, the second bias member urging the second plate in the direction that is substantially orthogonal to a direction of elevation of the first plate and the first end portion of the tension roll.

11. The ITM module of claim 1, wherein the cam surface slidingly engages with the other of the second end portion of the frame and the first plate such that different portions of the cam surface of the first cam member contacts the other of the second end portion of the frame and the first plate as the first cam member rotates.

12. An intermediate transfer member (ITM) assembly for an electrophotographic imaging device, comprising:

a frame;

a first roll disposed along a first end portion of the frame, the first roll being rotatable within the frame;

a second roll disposed along a second end portion of the frame, the second roll being rotatable within the frame and including a first end portion and a second end portion;

an ITM belt rotatably coupled to the frame and formed as an endless loop around the first roll and the second roll such that rotation of the first and second rolls cause the ITM belt to rotate; and an adjustment mechanism coupled to the second end portion of the frame and the second roll, the adjustment mechanism setting an amount of skew of the second roll relative to the second end portion of the frame, the amount of skew being in a direction that is substantially orthogonal to a process direction of the ITM belt, the adjustment mechanism including a first cam member pivotally coupled and pivots relative to one of the second end portion of the frame and the first end portion of the second roll and having a cam surface coupled to the other of the second end portion of the frame and the first end portion of the second roll such that rotating the first cam member sets an amount of elevation of the first end portion of the second roll relative to the second end portion of the frame.

13. The ITM assembly of claim 12, wherein the adjustment mechanism further comprises a plate member coupled between the second end portion of the frame and the first end portion of the second roll, the first cam member is rotatably coupled to one of the second end portion of the frame and the plate member and the cam surface is coupled to the other of the second end portion of the frame and the plate member, and rotating the first cam member sets the amount of elevation of the first end portion of the second roll and the plate member relative to the second end portion of the frame.

14. The ITM assembly of claim 13, further comprising a second cam member pivotally coupled to the one of the second end portion of the frame and the plate member and having a cam surface coupled to the other of the second end portion of the frame and the plate member, wherein rotating the first cam member and the second cam member sets the amount of elevation of the first end portion of the second roll and the plate member relative to the second end portion of the frame.

15. The ITM assembly of claim 14, wherein the plate member includes a first ledge which contacts the cam surface of the first cam member and a second ledge which contacts the cam surface of the second cam member, and wherein the first ledge is located along an upper portion of the plate member and the second ledge is located along a lower portion of the plate member.

16. The ITM assembly of claim 14, wherein the plate member includes a first slot in which the first cam member is at least partly disposed and a second slot in which the second cam member is at least partly disposed, the cam surface of the first cam member contacting an upper portion of the first slot.

17. The ITM assembly of claim 13, wherein the adjustment mechanism further comprises a bias member having a first end connected to the second end portion of the frame and a second end coupled to the plate member, the bias member urging the first end portion of the second roll in a direction substantially parallel with a processing direction of the ITM belt.

18. The ITM assembly of claim 12, wherein the first cam member is rotatably adjustable into each of a plurality of discrete positions relative to the one of the second end portion of the frame and the plate member, and wherein when the first cam member is in one of the plurality of discrete positions, the first cam member is secured in the one of the plurality of discrete positions via a snap fit engagement.

19. The ITM assembly of claim 18, wherein the adjustment mechanism further comprises a covering member covering at least a portion of the first cam member to prevent rotation thereof.

20. The ITM assembly of claim 12, wherein the cam surface slidingly engages with the other of the second end portion of the frame and the first end portion of the second roll such that different portions of the cam surface of the first cam member contacts the other of the second end portion of the frame and the first end portion of the second roll as the first cam member rotates.

* * * * *